United States Patent [19]

Matthews

[11] 4,171,762

[45] Oct. 23, 1979

[54] SPACE DIVIDER

[75] Inventor: Vincent C. Matthews, Plymouth, Mich.

[73] Assignee: Packaging Corporation of America, Evanston, Ill.

[21] Appl. No.: 931,453

[22] Filed: Aug. 7, 1978

[51] Int. Cl.[2] ..... B65D 5/48

[52] U.S. Cl. ..... 229/15

[58] Field of Search ..... 229/15, 42

[56] References Cited

U.S. PATENT DOCUMENTS

| | | | |
|---|---|---|---|
| 1,860,567 | 5/1932 | Boeye | 229/15 |
| 2,013,240 | 9/1935 | Harvey | 229/15 X |
| 2,517,767 | 8/1950 | Cody | 229/15 X |
| 2,830,749 | 4/1958 | Lauritzen | 229/15 |
| 3,301,460 | 1/1967 | Harrison | 229/15 |
| 3,738,561 | 6/1973 | Nederveld | 229/15 |

*Primary Examiner*—Davis T. Moorhead

*Attorney, Agent, or Firm*—Neuman, Williams, Anderson & Olson

[57] ABSTRACT

A space divider is provided for use within the interior of a container having a bottom and upstanding walls extending therefrom and delimiting same. The divider is formed from a single blank of foldable sheet material and includes first and second partitions arranged in spaced side-by-side relation. The first and second partitions are each formed of at least two panels in face-to-face relation and having corresponding first peripheral portions thereof foldably interconnected. Extending angularly from corresponding second peripheral portions of the first and second partitions is a pair of relatively spaced third partitions having the outer peripheral portions thereof foldably interconnected by a fourth partition. The fourth partition is spaced from the first and second partitions and coacts with the pair of third partitions to substantially span the distance between the first and second partitions. The panel of the first partition has a peripheral section thereof projecting therefrom in a direction towards the second partition. In a similar manner a panel of the second partition is provided with a peripheral section which projects towards the first partition.

10 Claims, 10 Drawing Figures

Fig.1.
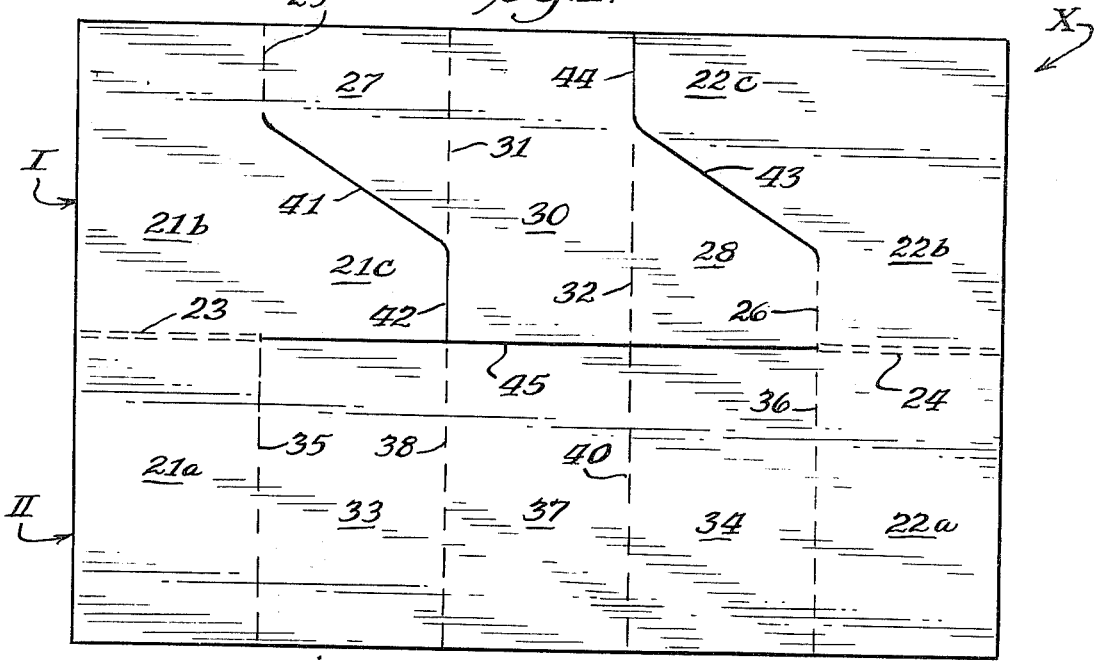
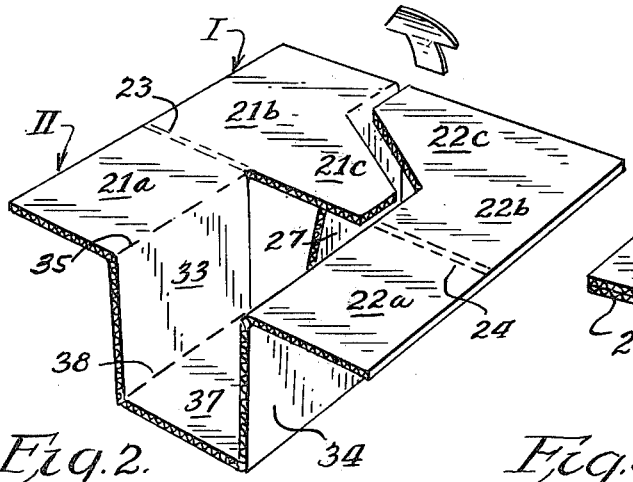
Fig.2.
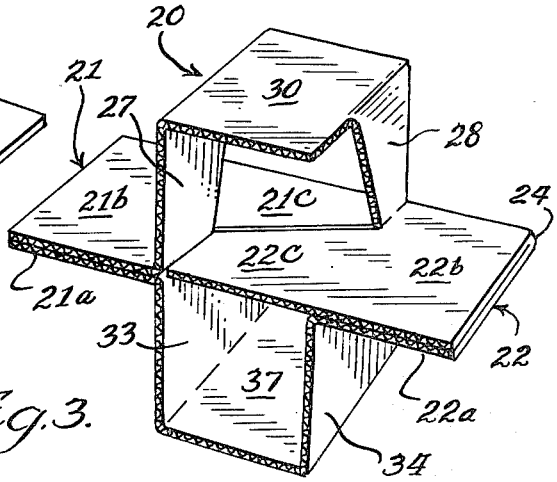
Fig.3.
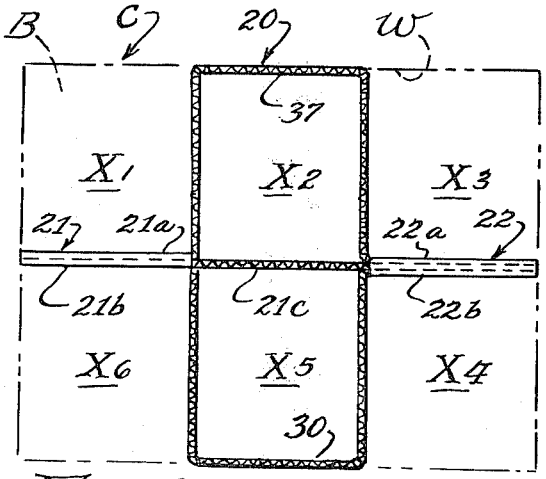
Fig.4.
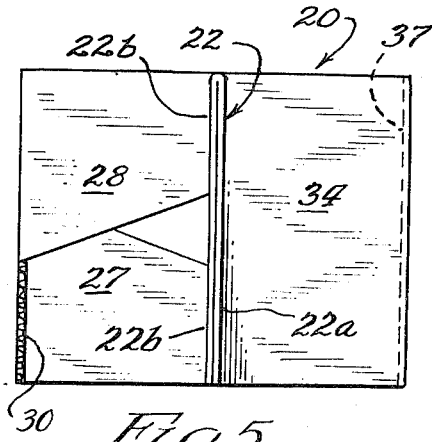
Fig.5.

Fig. 6.
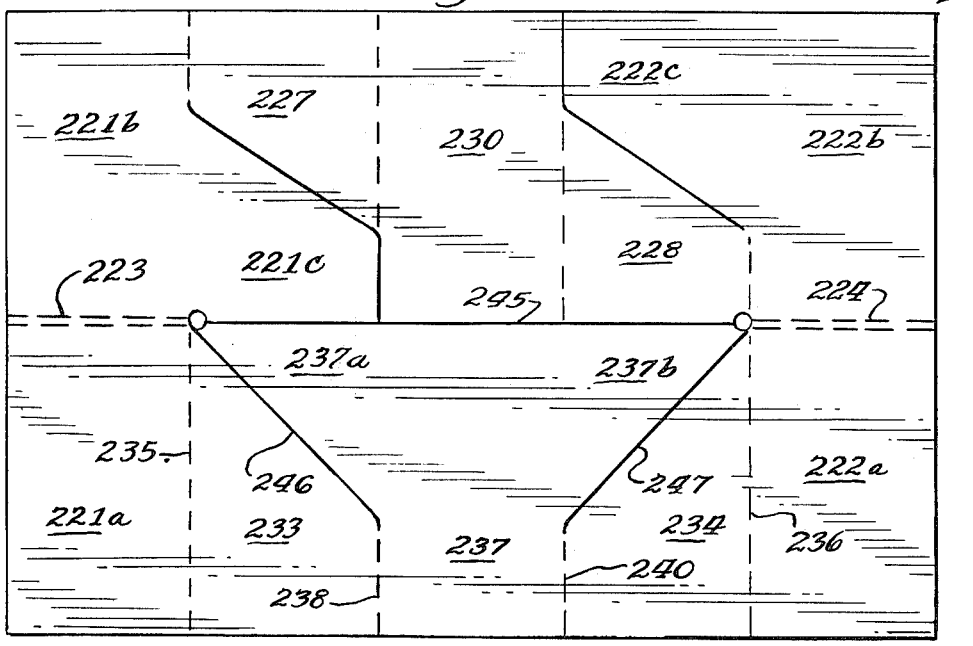
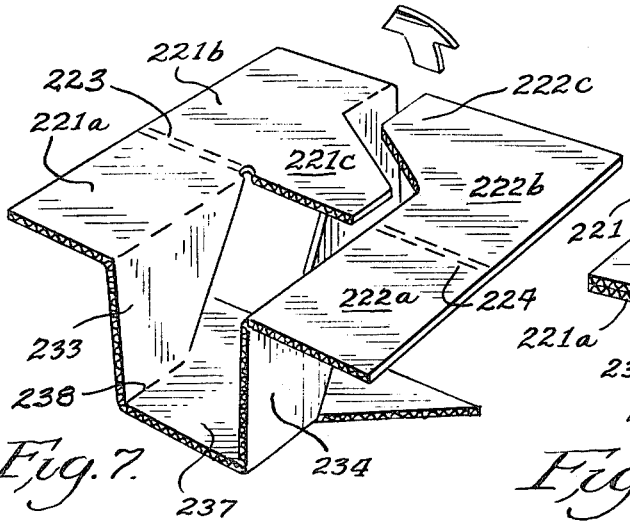
Fig. 7.
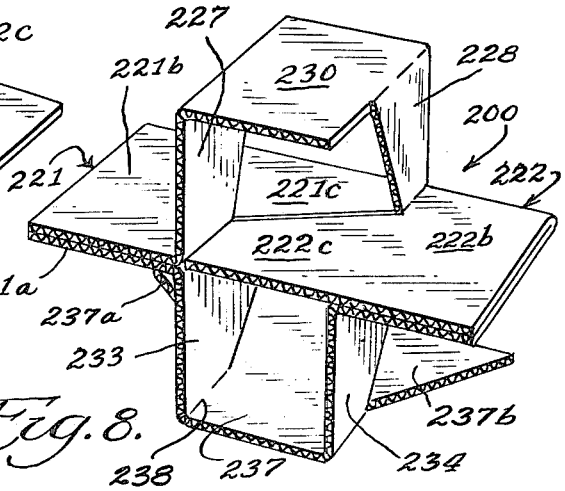
Fig. 8.
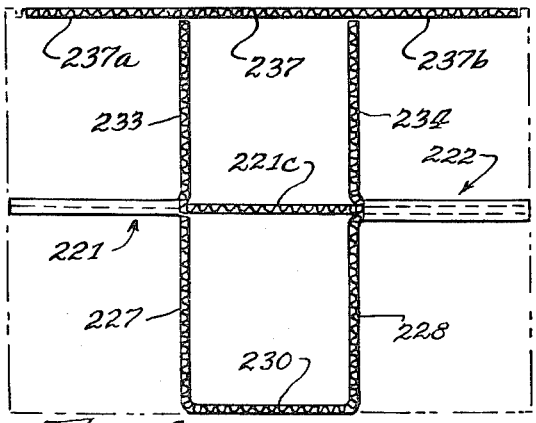
Fig. 9.
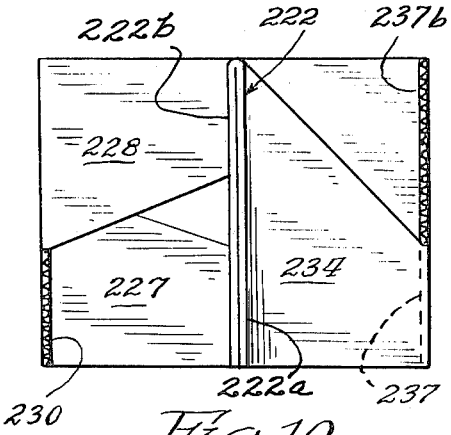
Fig. 10.

SPACE DIVIDER

BACKGROUND OF THE INVENTION

Various space dividers for shipping containers and the like have heretofore been provided; however, because of certain inherent design characteristics they have been possessed of one or more of the following shortcomings: (a) they were difficult to set up for use; (b) they required an inordinate amount of sheet material; (c) they were ineffective in providing the necessary protection for the products accommodated within the container; (d) they could not be collapsed so as to occupy a minimal amount of storage space; (e) they were incapable of providing increased stacking strength for the containers in which they were disposed; and (f) they were bulky and awkward to handle and reduced significantly the loading capacities of the containers in which they were disposed.

SUMMARY OF THE INVENTION

Thus, it is an object of the invention to provide a space divider which avoids all of the aforenoted shortcomings.

It is a further object of the invention to provide a space divider which is adapted to be accommodated by a variety of containers.

It is a further object of the invention to provide a space divider, the blank of which is of simple configuration, inexpensive to produce with conventional high speed slotting, slitting and scoring equipment, and results in a minimal amount of waste material being produced.

Further and additional objects will appear from the description, accompanying drawings and appended claims.

In accordance with one embodiment of the invention, a space divider is provided which is formed from a single blank of foldable sheet material (e.g., double-faced corrugated fibreboard). The space divider is adapted to be removably positioned within the interior of a container having a bottom and upstanding walls extending therefrom and delimiting same. The space divider includes first and second partitions arranged in spaced, side-by-side relation. Each partition includes at least a pair of panels arranged in face-to-face relation and having corresponding first peripheral portions thereof foldably interconnected. Foldably connected to second peripheral portions of corresponding panels of the first and second partitions is a pair of third partitions. Outwardly disposed portions of the third partitions are foldably interconnected by a fourth partition which coacts with the third partitions to span the distance between the first and second partitions. Corresponding panels of the first and second partitions are provided with protruding peripheral sections which extend into the space between the first and second partitions.

DESCRIPTION

For a more complete understanding of the invention reference should be made to the drawings wherein:

FIG. 1 is a plan view of a blank from which one embodiment of the improved space divider is formed.

FIG. 2 is a perspective top view of the blank of FIG. 1 in a state of partial setup.

FIG. 3 is a perspective end view of a fully set up space divider formed from the blank of FIG. 1.

FIG. 4 is a top plan view of the space divider of FIG. 3 disposed within the interior of a container, the latter being shown in phantom lines.

FIG. 5 is a side elevational view of the space divider shown in FIG. 4.

FIG. 6 is similar to FIG. 1 and shows a blank for a second embodiment of the improved space divider.

FIGS. 7–10 are similar to FIGS. 2–5, respectively, and relate to the second embodiment of the improved space divider.

Referring now to the drawings and more particularly to FIGS. 3–5, one embodiment of the improved space divider 20 is shown which is adapted to be removably positioned within the interior of a conventional shipping container C or the like. The container may be a variety of styles (e.g., an RSC, OSC, HSC, etc.). The container interior, during loading, is formed by a bottom B, which subtends and supports the divider 20 and the products accommodated therein, and upright walls W which delimit the bottom. Once the divider has been positioned within the container interior and the products loaded into the various compartments $X_1$, $X_2$, $X_3$, $X_4$, $X_5$ and $X_6$ formed by the divider, the top of the container is closed by a suitable means, not shown.

Space divider 20, when fully set up, includes first and second partitions 21, 22 which are arranged in spaced, side-by-side relation. Normally, the outer opposed edges of the partitions 21, 22 are adapted to slidably engage the inner surfaces of one set of opposed walls of the container, see FIG. 4. Each partition in the illustrated embodiment is formed from a pair of panels **21*a*, 21*b* or 22*a*, 22*b* which are arranged in face-to-face relation. Corresponding peripheral portions of the panels of each pair are interconnected by a foldline 23, 24, see the blank X in FIG. 1. Panels 21*b*, 22*b* are each provided with a laterally projecting peripheral section 21*c*, 22*c*. The peripheral sections 21*c*, 22*c* extend in opposite directions towards the outer partition and are disposed in substantially side-by-side coextensive relation when the space divider is set up, see FIG. 2. The sections 21*c*, 22*c* coact to form a separator between compartments $X_2$ and $X_5$, see FIG. 4**, and prevent direct contact between the products disposed within such compartments.

Foldably connected by foldlines 25, 26 to peripheral portions of panels **21*b*, 22*b*, respectively, and adjacent the peripheral sections 21*c*, 22*c* is a pair of third partitions 27, 28. A fourth partition 30 is connected by parallel foldlines 31, 32 to corresponding edges of partitions 27, 28**.

In a similar manner, a pair of fifth partitions 33, 34 are connected by foldlines 35, 36 to peripheral portions of panels **21*a*, 22*a*, see FIG. 1. Corresponding edges of the fifth partitions 33, 34 are connected to a sixth partition 37 by foldlines 38, 40. Because there are no peripheral sections, such as sections 21*c*, 22*c*, extending from panels 21*a*, 22*a*, the fifth partitions 33, 34** are substantially coextensive therewith.

It will be noted in blank X that peripheral section **21*c* and third partition 27 are separated from one another by a substantially diagonally extending slit 41 having one end thereof terminating at foldline 25 and the opposite end thereof terminating at a slit 42, the latter separating peripheral section 21*c* from fourth partition 30**.

A similar arrangement of slits 43, 44 is provided in the blank with respect to peripheral section **22*c* and third partition 28; and peripheral section 22***c* and fourth partition 30.

An elongated slit 45 is also provided in the blank which is aligned with and disposed between foldlines 23, 24. Slit 45 separates fifth partition 33 and peripheral section 21*c;* sixth partition 37 and fourth partition 30; and fifth partition 34 and third partition 28. The slit 45 permits the blank to be readily set up to form the divider 20.

In setting up the divider 20, the third, fourth, fifth and sixth partitions are initially folded relative to one another and to the panels 21*a*, 21*b* and 22*a*, 22*b* of the first and second partitions so as to form a channel-like configuration, as seen in FIG. 2. It will be noted that peripheral sections 21*c*, 22*c* remain in substantially coplanar relation with panels 21*b*, 22*b* and substantially overlie in spaced relation the fourth partition 30. Once the blank has assumed the partial setup condition, shown in FIG. 2, a half I of the blank X, which includes panels 21*b*, 22*b;* peripheral sections 21*c*, 22*c;* third partitions 27, 28; and fourth partition 30, is folded as a unit about foldlines 23, 24 so as to overlie the other half II of the blank, the latter including panels 21*a*, 22*a;* fifth partitions 33, 34; and sixth partition 37, see FIG. 3. When the blank is fully set up to form divider 20, the corresponding third and fifth partitions 27–33 and 28–34 are disposed in coplanar relation and are disposed at substantially right angles to the panels of the first and second partitions 21, 22. Furthermore, as noted in FIG. 5, the panels of the first and second partitions, and the fourth, fifth and sixth partitions, all have a height substantially equal to the height of the container walls and thus significantly increase the load-bearing capabilities of the loaded container C.

As seen in FIG. 4, the fourth and sixth partitions 30, 37 are disposed in face-to-face engagement with the inner surfaces of the second set of opposed walls of the container. The container C, shown in phantom lines in FIG. 4, is of rectangular configuration; thus, the two sets of opposed container walls are at right angles to one another. It should be understood, of course, that the improved space divider is not limited to containers of this shape but may be modified to accommodate containers of different shapes (square, hexagonal, etc.).

FIG. 6 shows a modified form of blank Y which is adapted to be set up so as to form a modified space divider 200, see FIG. 8. To facilitate understanding of divider 200, parts thereof corresponding to parts of divider 20 will be given like numbers but in a two hundred series.

The principal structural difference between the dividers 20 and 200 is that in the latter the sixth partition 237 is provided with laterally extending wing-like projections 237*a*, 237*b*. The projections are formed from the adjacent fifth partitions 233, 234 by diagonally extending slits 246, 247, see FIG. 6. Slit 246 extends from foldline 238 to the intersection of foldlines 235 and 223. In a similar manner, slit 247 extends from foldline 240 to the intersection of foldlines 236 and 224. The shape and size of the projections 237*a*, 237*b* may be readily varied from that shown by varying the configuration of the slits.

The remainder of divider 200, in the illustrated embodiment, is substantially the same as divider 20 and the procedure for setting up blank Y into the divider is the same as that described for blank X. By reason of the wing-like projections 237*a*, 237*b*, a substantially greater area of the inner surface of one wall of the container is engaged and reinforced by the partition 237, see FIG. 9.

As seen in FIGS. 1 and 6, there is a minimal amount of material waste produced in forming either of the blanks X and Y. The blanks are of simple configuration and may be formed of a variety of materials (e.g., double-faced corrugated fibreboard or the like). In both forms of the illustrated dividers 20, 200, a separator formed by projections 21*c*, 22*c* or 221*c*, 222*c* and the various partitions provide means for substantially segregating adjacent compartments from one another and thereby prevent, or minimize, the possibility of contact or intermixing of the products disposed within adjacent compartments during normal handling of a loaded container utilizing either form of the improved divider.

Because of the simple and expeditious manual manipulations required to fully set up either blank, the set up operation may be delayed until the container is to be loaded. Thus, either blank may be readily stored or shipped in bulk to a customer while in an unfolded state.

I claim:

1. A space divider formed from a single blank of foldable sheet material for use within the interior of a container having a bottom and upstanding walls extending therefrom and delimiting same, said divider comprising a first partition; a second partition in spaced substantially side-by-side relation with respect to said first partition, each partition including at least two panels arranged in face-to-face relation and having corresponding first peripheral portions thereof foldably interconnected, a peripheral section of one panel of each partition projecting towards the other partition; a pair of third partitions projecting angularly from a corresponding surface of said first and second partitions, one of said third partitions having a peripheral segment thereof foldably connected to a second peripheral portion of the one panel of said first partition, and the other of said third partitions having a peripheral segment thereof foldably connected to a second peripheral portion of the one panel of said second partition; and a fourth partition foldably interconnecting corresponding second peripheral segments of said pair of third partitions, said fourth partition being in spaced substantially parallel relation with said first and second partitions.

2. The space divider of claim 1 wherein the third partions are disposed in spaced substantially parallel relation.

3. The space divider of claim 1 wherein the third and fourth partitions coact to span the distance between said first and second partitions.

4. The space divider of claim 1 wherein the projecting peripheral sections of said first and second partitions are disposed in substantially coplanar coextensive relation.

5. The space divider of claim 1 wherein the second panels of said first and second partitions have a pair of fifth partitions foldably connected thereto and projecting angularly from a corresponding second surface of said first and second partitions, portions of said fifth partitions being foldably interconnected by a sixth partition, the latter being spaced from said first and second partitions.

6. The space divider of claim 5 wherein the fifth partitions are disposed in spaced substantially parallel relation.

7. The space divider of claim 5 wherein said pair of third partitions and said pair of fifth partitions project outwardly in substantially opposite directions from said first and second partitions.

8. The space divider of claim 7 wherein said pair of third partitions and said pair of fifth partitions are disposed in perpendicular relation with respect to said first and second partitions.

9. The space divider of claim 8 wherein the fourth partition and the sixth partition are in substantially parallel relation to said first and second partitions and are spaced therefrom a substantially like amount.

10. The space divider of claim 1 wherein said fourth partition has peripheral portions extending laterally in opposite directions from said pair of third partitions.

* * * * *